US007687703B2

(12) United States Patent
Molloy et al.

(10) Patent No.: US 7,687,703 B2
(45) Date of Patent: Mar. 30, 2010

(54) METHOD AND DEVICE FOR GENERATING TRIANGULAR WAVES

(75) Inventors: Stephen Molloy, Carlsbad, CA (US); Suresh Devalapalli, San Diego, CA (US); Nidish Ramachandra Kamath, Placentia, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 12/042,190

(22) Filed: Mar. 4, 2008

(65) Prior Publication Data

US 2008/0229920 A1 Sep. 25, 2008

Related U.S. Application Data

(60) Provisional application No. 60/896,463, filed on Mar. 22, 2007.

(51) Int. Cl.
*H03K 4/06* (2006.01)
*G10H 1/00* (2006.01)

(52) U.S. Cl. ..... 84/600; 327/131; 331/135; 331/108 B

(58) Field of Classification Search ..... 84/600–602; 327/131; 331/108 B, 107 A, 135–137
See application file for complete search history.

(56) References Cited

U.S. PATENT DOCUMENTS 3,621,470 A * 11/1971 Davis ..... 332/102
3,628,055 A * 12/1971 Lum ..... 327/126
3,649,845 A * 3/1972 Foch ..... 327/131
3,689,914 A * 9/1972 Butler ..... 341/147
4,119,005 A 10/1978 Kondo et al.
4,259,888 A * 4/1981 Gross ..... 84/627
4,449,059 A * 5/1984 Dickes ..... 327/132
4,516,038 A * 5/1985 Glennon ..... 327/113
4,524,334 A * 6/1985 Brajder et al. ..... 331/135
4,651,025 A * 3/1987 Smeulers ..... 327/132

(Continued)

FOREIGN PATENT DOCUMENTS

EP 0321794 A2 * 6/1989

(Continued)

OTHER PUBLICATIONS

International Search Report—PCT/US2008/057269, International Searching Authority—European Patent Office—Jul. 22, 2008.

(Continued)

*Primary Examiner*—David S. Warren
(74) *Attorney, Agent, or Firm*—Espartaco Diaz Hidalgo

(57) ABSTRACT

This disclosure describes techniques for generating a set of data points that form a triangular wave having a desired gain and a desired frequency. In one example, the method includes the step of (a) determining an increment value based on the desired frequency and the desired gain of the triangular wave. The method further includes the step of (b) adding the increment value to a current data point to generate a next data point, the current data point and the next data point forming a subset of the set of data points. The method further includes the step of iteratively performing (a) and (b) to generate the set of data points that form the triangular wave.

50 Claims, 5 Drawing Sheets

U.S. PATENT DOCUMENTS

| | | | | | |
|---|---|---|---|---|---|
| 4,926,131 | A | * | 5/1990 | Leydier | 327/126 |
| 5,013,931 | A | * | 5/1991 | Estes, Jr. | 327/140 |
| 5,206,446 | A | | 4/1993 | Matsumoto et al. | |
| 5,414,210 | A | | 5/1995 | Sato | |
| 5,477,174 | A | * | 12/1995 | Capener et al. | 327/131 |
| 5,502,419 | A | * | 3/1996 | Kawasaki et al. | 332/109 |
| 5,640,131 | A | * | 6/1997 | Kawasaki et al. | 332/109 |
| 5,714,897 | A | * | 2/1998 | Vitunic et al. | 327/136 |
| 5,917,313 | A | * | 6/1999 | Callahan, Jr. | 323/288 |
| 6,058,066 | A | | 5/2000 | Norris et al. | |
| 6,194,863 | B1 | * | 2/2001 | Mainberger | 318/696 |
| 6,348,781 | B1 | * | 2/2002 | Midya et al. | 323/224 |
| 6,356,125 | B1 | * | 3/2002 | Greenwood | 327/131 |
| 7,002,381 | B1 | * | 2/2006 | Chung | 327/131 |
| 7,332,730 | B2 | * | 2/2008 | Heinitz et al. | 250/491.1 |
| 7,397,883 | B2 | * | 7/2008 | Hattori | 375/376 |
| 7,505,139 | B2 | * | 3/2009 | Bergh | 356/464 |
| 7,515,656 | B2 | * | 4/2009 | Yamaguchi et al. | 375/326 |
| 7,557,622 | B2 | * | 7/2009 | Stanley | 327/131 |
| 2002/0036523 | A1 | * | 3/2002 | Tam | 327/131 |
| 2005/0146303 | A1 | * | 7/2005 | Fukamizu et al. | 318/696 |
| 2007/0052459 | A1 | * | 3/2007 | Ikezawa | 327/131 |
| 2007/0109029 | A1 | * | 5/2007 | Stanley | 327/131 |
| 2007/0182464 | A1 | * | 8/2007 | Sekiguchi et al. | 327/131 |
| 2007/0182465 | A1 | * | 8/2007 | Fukumoto | 327/131 |
| 2008/0229920 | A1 | * | 9/2008 | Molloy et al. | 84/645 |
| 2008/0303563 | A1 | * | 12/2008 | Kubo | 327/131 |

FOREIGN PATENT DOCUMENTS

| | | | | |
|---|---|---|---|---|
| JP | 2000286682 | A | * 10/2000 | |
| SU | 790278 | | * 12/1980 | 327/131 |
| SU | 1370740 | | * 1/1988 | 327/131 |

OTHER PUBLICATIONS

Written Opinion—PCT/US2008/057269, International Searching Authority—European Patent Office—Jul. 22, 2008.

* cited by examiner

METHOD AND DEVICE FOR GENERATING TRIANGULAR WAVES

RELATED APPLICATIONS

Claim of Priority Under 35 U.S.C. §119

The present Application for Patent claims priority to Provisional Application No. 60/896,463 entitled "METHOD AND DEVICE FOR GENERATING TRIANGULAR WAVES" filed Mar. 22, 2007, and assigned to the assignee hereof and hereby expressly incorporated by reference herein.

TECHNICAL FIELD

The invention relates to an electronic device, and particularly to an electronic device that can generate triangular waves.

BACKGROUND

Musical Instrument Digital Interface (MIDI) is a format for the creation, communication and playback of audio sounds, such as music, speech, tones, alerts, and the like. A device that supports the MIDI format may store sets of audio information that can be used to create various "voices." Each voice may correspond to a particular sound, such as a musical note by a particular instrument. For example, a first voice may correspond to a middle C as played by a piano, a second voice may correspond to a middle C as played by a trombone, a third voice may correspond to a D# as played by a trombone, and so on. In order to replicate the sounds played by various instruments, a MIDI compliant device may include a set of information for voices that specify various audio characteristics, such as the behavior of a low frequency oscillator, effects such as vibrato, and a number of other audio characteristics that can affect the perception of different sounds. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be coded in accordance with the MIDI format by specifying events that indicate when certain voices should start and stop. In this way, the musical composition may be stored and transmitted in a compact file format according to the MIDI format.

MIDI is supported in a wide variety of devices. For example, wireless communication devices, such as radiotelephones, may support MIDI files for downloadable ringtones or other audio output. Digital music players, such as the "iPod" devices sold by Apple Computer, Inc and the "Zune" devices sold by Microsoft Corp. may also support MIDI file formats. Other devices that support the MIDI format may include various music synthesizers such as keyboards, sequencers, voice encoders (vocoders), and rhythm machines. In addition, a wide variety of devices may also support playback of MIDI files or tracks, including wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, video game consoles, various computerized toys for children, on-board computers used in automobiles, watercraft and aircraft, and a wide variety of other devices.

A number of other types of audio formats, standards and techniques have also been developed. Other examples include standards defined by the Motion Pictures Expert Group (MPEG), windows media audio (WMA) standards, standards by Dolby Laboratories, Inc., and quality assurance techniques developed by THX, ltd., to name a few. Moreover, many audio coding standards and techniques continue to emerge, including the digital MP3 standard and variants of the MP3 standard, such as the advanced audio coding (AAC) standard used in "iPod" devices. Various video coding standards may also use audio coding techniques, e.g., to code multimedia frames that include audio and video information.

One important feature of the MIDI format is its ability to store data related to the articulation of a particular note. The articulation data includes information about sound effects, such as a vibrato or a tremolo, which can help to emulate the sound of an acoustic instrument. A device that utilizes MIDI may implement these effects using a combination of low frequency oscillators and envelope generators. Typically, a low frequency oscillator (LFO) can be used to generate a periodic low-frequency wave to modulate the pitch, amplitude, and frequency of a particular note. In order to generate a low-frequency wave that operates within acceptable tolerance ranges, numerous and complex calculations are required, which can require the storage of a number of parameters and the utilization of a significant amount of chip area.

SUMMARY

In general, this disclosure describes techniques for generating triangular waves. The techniques may be particularly useful for playback of audio files that comply with the musical instrument digital interface (MIDI) format, although the techniques may be useful with other audio formats, techniques or standards.

In one aspect, this disclosure provides a method for generating a set of data points that form a triangular wave having a desired frequency and a desired gain. The method includes the step of (a) determining an increment value based on the desired frequency and the desired gain of the triangular wave. The method further includes the step of (b) adding the increment value to a current data point to generate a next data point, the current data point and the next data point forming a subset of the set of data points. The method further includes the step of iteratively performing (a) and (b) to generate the set of data points that form the triangular wave.

In another aspect, this disclosure provides a device for generating a set of data points that form a triangular wave having a desired frequency and a desired gain. The device includes an electrical circuit that determines an increment value based on the desired frequency and the desired gain of the triangular wave. The device further includes an adder that adds the increment value to a current data point to generate a next data point, the current data point and the next data point forming a subset of the set of data points, wherein the electrical circuit iteratively determines increment values and the adder iteratively adds the increment values to successive data points to generate the set of data points that form the triangular wave.

In another aspect, this disclosure provides a device for generating a set of data points that form a triangular wave having a desired frequency and a desired gain. The device includes a first means for determining an increment value based on the desired frequency and the desired gain of the triangular wave. The device further includes a second means for adding the increment value to a current data point to generate a next data point, the current data point and the next data point forming a subset of the set of data points, wherein the first means iteratively determines increment values and the second means iteratively adds the increment values to successive data points to generate the set of data points that form the triangular wave.

Various aspects of the techniques described in this disclosure may be implemented in hardware, software, firmware, or any combination thereof. If implemented in software, the software may be executed in one or more processors, such as a microprocessor, application specific integrated circuit (ASIC), field programmable gate array (FPGA), or digital signal processor (DSP). The software that executes the techniques may be initially stored in a computer-readable medium and loaded and executed in the processor.

Accordingly, this disclosure also contemplates a computer-readable medium comprising instructions that upon execution by one or more processors cause the processors to generate a set of data points that form a triangular wave having a desired frequency and a desired gain, wherein the instructions cause the one or more processors to: (a) determine an increment value based on the desired frequency and the desired gain of the triangular wave, (b) add the increment value to a current data point to generate a next data point, the current data point and the next data point forming a subset of the set of data points, and iteratively perform (a) and (b) to generate the set of data points that form the triangular wave.

In some cases, the computer readable medium may form part of a computer program product, which may be sold to manufactures and/or used in a video coding device. The computer program product may include a computer readable medium, and in some cases, may also include packaging materials.

In other cases, this disclosure may be directed to a circuit, such as an integrated circuit, chipset, application specific integrated circuit (ASIC), field programmable gate array (FPGA), logic, or various combinations thereof configured or adapted to perform one or more of the techniques described herein.

Accordingly, this disclosure also contemplates a circuit for generating a set of data points that form a triangular wave having a desired frequency and a desired gain, wherein the circuit is adapted to: (a) determine an increment value based on the desired frequency and the desired gain of the triangular wave, (b) add the increment value to a current data point to generate a next data point, the current data point and the next data point forming a subset of the set of data points, and iteratively perform (a) and (b) to generate the set of data points that form the triangular wave.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
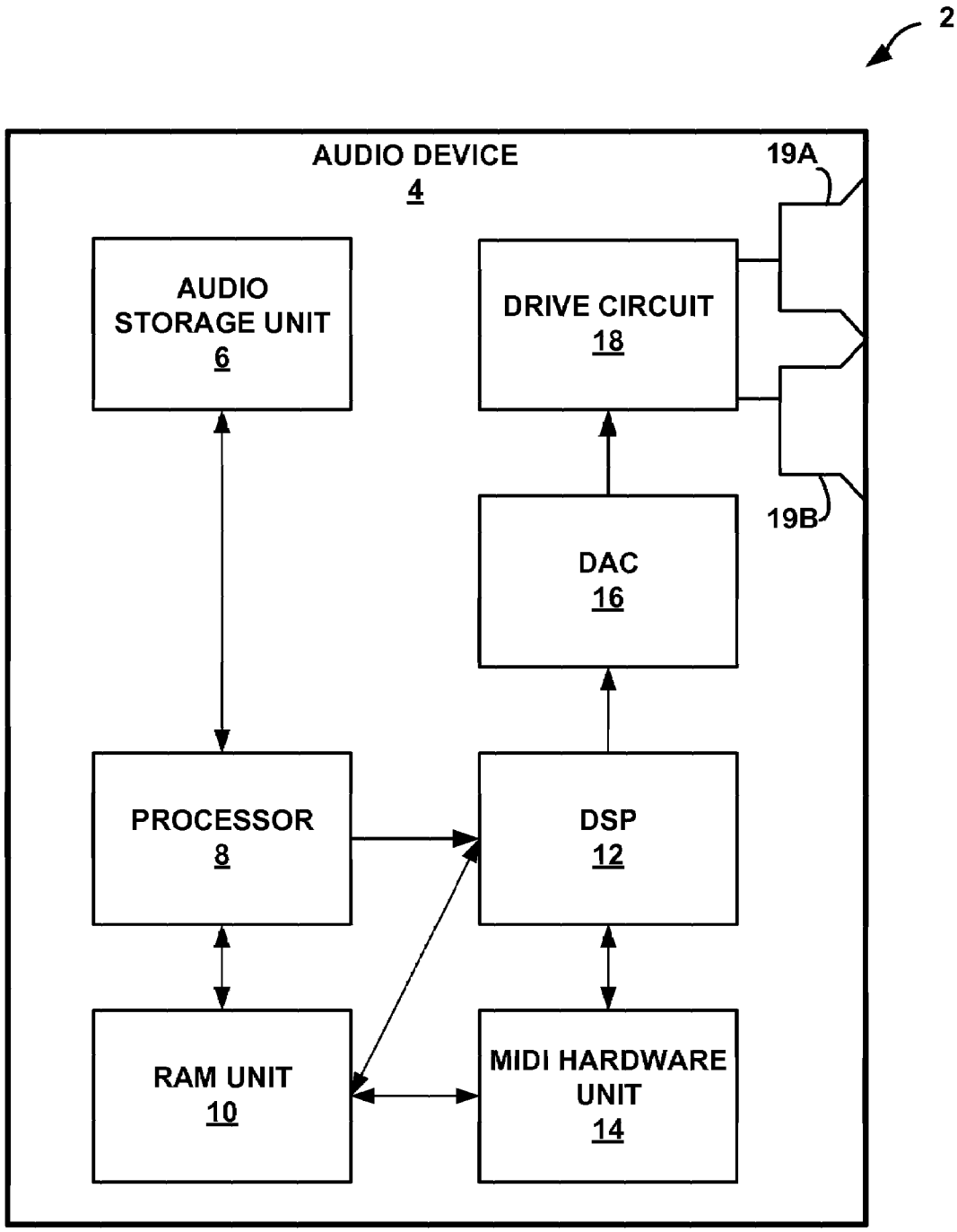
FIG. 1 is a block diagram illustrating an exemplary audio device that may implement techniques for processing audio files in accordance with this disclosure.

This disclosure describes techniques for generating triangular waves. The techniques may be particularly useful for playback of audio files that comply with the musical instrument digital interface (MIDI) format, although the techniques may be useful with other audio formats, techniques or standards that make use of triangular waves. As used herein, the term MIDI file refers to any audio data or file that contains at least one audio track that conforms to the MIDI format. Examples of various file formats that may include MIDI tracks include CMX, SMAF, XMF, SP-MIDI to name a few. CMX stands for Compact Media Extensions, developed by Qualcomm Inc. SMAF stands for the Synthetic Music Mobile Application Format, developed by Yamaha Corp. XMF stands for eXtensible Music Format, and SP-MIDI stands for Scalable Polyphony MIDI.

MIDI files, or other audio files can be conveyed between devices within audio frames, which may include audio information or audio-video (multimedia) information. An audio frame may comprise a single audio file, multiple audio files, or possibly one or more audio files and other information such as coded video frames. Any audio data within an audio frame may be termed an audio file, as used herein, including streaming audio data or one or more audio file formats listed above. A plurality of hardware elements that operate simultaneously can be used to service various synthesis parameters generated from one or more audio files, such as MIDI files.

A general purpose processor may execute software to parse MIDI files and schedule MIDI events associated with the MIDI files. The scheduled events can then be serviced by a DSP in a synchronized manner, as specified by timing parameters in the MIDI files. The general purpose processor dispatches the MIDI events to the DSP in a time-synchronized manner, and the DSP processes the MIDI events according to the time-synchronized schedule in order to generate MIDI synthesis parameters. The DSP then schedules processing of the synthesis parameters in hardware, and a hardware unit can generates audio samples based on the synthesis parameters.

The general purpose processor may service MIDI files for a first frame (frame N), and when the first frame (frame N) is serviced by the DSP, a second frame (frame N+1) can be simultaneously serviced by the general purpose processor. Furthermore, when the first frame (frame N) is serviced by the hardware, the second frame (frame N+1) is simultaneously serviced by the DSP while a third frame (frame N+2) is serviced by the general purpose processor. In this way, MIDI file processing is separated into pipelined stages that can be processed at the same time, which can improve efficiency and possibly reduce the computational resources needed for given stages, such as those associated with the DSP. Each frame passes through the various pipeline stages, from the general purpose processor, to the DSP, and then to the hardware. In some cases, audio samples generated by the hardware may be delivered back to the DSP, e.g., via interrupt-driven techniques, so that any post-processing can be performed. Audio samples may then be converted into analog signals, which can be used to drive speakers and output audio sounds to a user.

Alternatively, the tasks associated with MIDI file processing can be delegated between two different threads of a DSP and the dedicated hardware. That is to say, the tasks associated with the general purpose processor (as described herein) could alternatively be executed by a first thread of a multi-threaded DSP. In this case, the first thread of the DSP executes the scheduling, a second thread of the DSP generates the synthesis parameters, and the hardware unit generates audio samples based on the synthesis parameters. This alternative example may also be pipelined in a manner similar to the example that uses a general purpose processor for the scheduling.

FIG. 1 is a block diagram illustrating an exemplary audio device 4. As an example, audio device 4 may comprise any device capable of processing MIDI files, e.g., files that include at least one MIDI track. Again, however, the techniques of this disclosure may find application with other audio formats, techniques or standards. Examples of audio device 4 include a wireless communication device such as a radiotelephone, a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, an audio circuit board installed in a device, a kiosk device, a video game console, various computerized toys for children, an on-board computer used in an automobile, watercraft or aircraft, or a wide variety of other devices that process and output audio.

The various components illustrated in FIG. 1 are provided to explain aspects of this disclosure. However, other components may exist and some of the illustrated components may not be included in some implementations. For example, if audio device 4 is a radiotelephone, then an antenna, transmitter, receiver and modem (modulator-demodulator) may be included to facilitate wireless communication of audio files.

As illustrated in the example of FIG. 1, audio device 4 includes an audio storage unit 6 to store audio files, such as MIDI files. Again, MIDI files generally refer to any audio file that includes at least one track coded in the MIDI format. Audio storage unit 6 may comprise any volatile or non-volatile memory or storage. For purposes of this disclosure, audio storage unit 6 can be viewed as a storage unit that forwards audio files to processor 8, or processor 8 retrieves MIDI files from audio storage unit 6, in order for the files to be processed. Audio storage unit 6 could also be a storage unit associated with a digital music player or a temporary storage unit associated with information transfer from another device. For example, audio storage unit 6 may buffer streaming audio obtained from a server or broadcast source. Audio storage unit 6 may be a separate volatile memory chip or non-volatile storage device coupled to processor 8 via a data bus or other connection. A memory or storage device controller (not shown) may be included to facilitate the transfer of information from audio storage unit 6.

Device 4 may implement an architecture that separates audio processing tasks between software, hardware and firmware. As shown in FIG. 1, device 4 includes a processor 8, a digital signal processor (DSP) 12 and an audio hardware unit 14. Each of these components may be coupled to a local memory unit 10, e.g., directly or via a bus. Processor 8 may comprise a general purpose processor that executes software to parse audio files and schedule audio events associated with the audio files. The scheduled events can be dispatched to DSP 12 in a time-synchronized manner and thereby serviced by DSP 12 in a synchronized manner, as specified by timing parameters in the audio files. DSP 12 may comprise firmware that processes the audio events according to the time-synchronized schedule created by general purpose processor 8 in order to generate synthesis parameters. DSP 12 may also schedule subsequent processing of the synthesis parameters by audio hardware unit 14.

Once DSP 12 has generated the synthesis parameters, these synthesis parameters can be stored in memory unit 10. Memory unit 10 may comprise volatile or non-volatile storage. In order to support quick data transfer, memory unit 10 may comprise random access memory (RAM), dynamic random access memory (DRAM), synchronous dynamic random access memory (SDRAM), FLASH memory, or the like. The synthesis parameters stored in memory unit 10 can be serviced by audio hardware unit 14 to generate audio samples.

The audio hardware unit 14 may include several processing elements for servicing the synthesis parameters. The processing elements may comprise an arithmetic logic unit (ALU) that supports operations such as multiply, add and accumulate. In addition, each processing element may also support hardware specific operations for loading and/or storing to other hardware components. The other hardware components in audio hardware unit 14, for example, may comprise a low frequency oscillator (LFO), a wave fetch unit (WFU), and a summing buffer (SB). Thus, the processing elements in audio hardware unit 14 may support and execute instructions for interacting and using these other hardware components in the audio processing. In accordance with this disclosure, a processing element may interact with the low frequency oscillator in order to generate a particular articulation sound effect such as a vibrato or a tremolo. The low frequency oscillator may provide a periodic waveform, such as a triangular wave, in response to specific parameters provided to the LFO by a processing element. For example, the processing element may specify the desired gain and the desired frequency of a triangular wave in an instruction to the low frequency oscillator. In response, the LFO may provide a series of data points corresponding to the triangular wave requested by the processing element. Additional details of one example of audio hardware unit 14 are provided in greater detail below with reference to FIG. 2.

In some cases, the processing of audio files by device 4 may be pipelined. For example, processor 8, DSP 12 and audio hardware unit 14 may operate simultaneously with respect to successive audio frames. Each audio frames may correspond to a block of time, e.g., a 10 millisecond (ms) interval that includes many coded audio samples. Digital output of hardware unit 14, for example, may include 480 digital audio samples per audio frame, which can be converted into an analog audio signal by digital-to-analog converter 16. Many events may correspond to one instance of time so that many different sounds or notes can be included in one instance of time according to the MIDI format or similar audio format. Of course, the amount of time delegated to any audio frame and the number of audio samples defined in one frame may vary in different implementations.

In some cases, audio samples generated by audio hardware unit 14 are delivered back to DSP 12, e.g., via interrupt-driven techniques. In this case, DSP 12 may also perform post processing techniques on the audio samples. The post processing may include filtering, scaling, volume adjustment, or a wide variety of audio post processing that may ultimately enhance the sound output. Digital-to-analog converter (DAC) 16 then converts the audio samples into analog signals, which can be used by drive circuit 18 to drive speakers 19A and 19B for output of audio sounds to a user.

Local memory 10 may be structured such that processor 8, DSP 12 and MIDI hardware 14 can access any information needed to perform the various tasks delegated to these different components. In some cases, the storage layout of MIDI information in local memory 10 may be arranged to allow for efficient access from the different components 8, 12 and 14. Again, local memory 10 is used to store (among other things) the synthesis parameters associated with one or more audio files. Once DSP 12 generates these synthesis parameters, they can be processed by hardware unit 14 to generate audio samples. The audio samples generated by audio hardware unit 14 may comprise pulse-code modulation (PCM) samples, which are a digital representations of an analog signal wherein the analog signal is sampled at regular intervals. Additional details of exemplary audio generation by audio hardware unit 14 is discussed in greater detail below with reference to FIG. 2.

Figure 2:
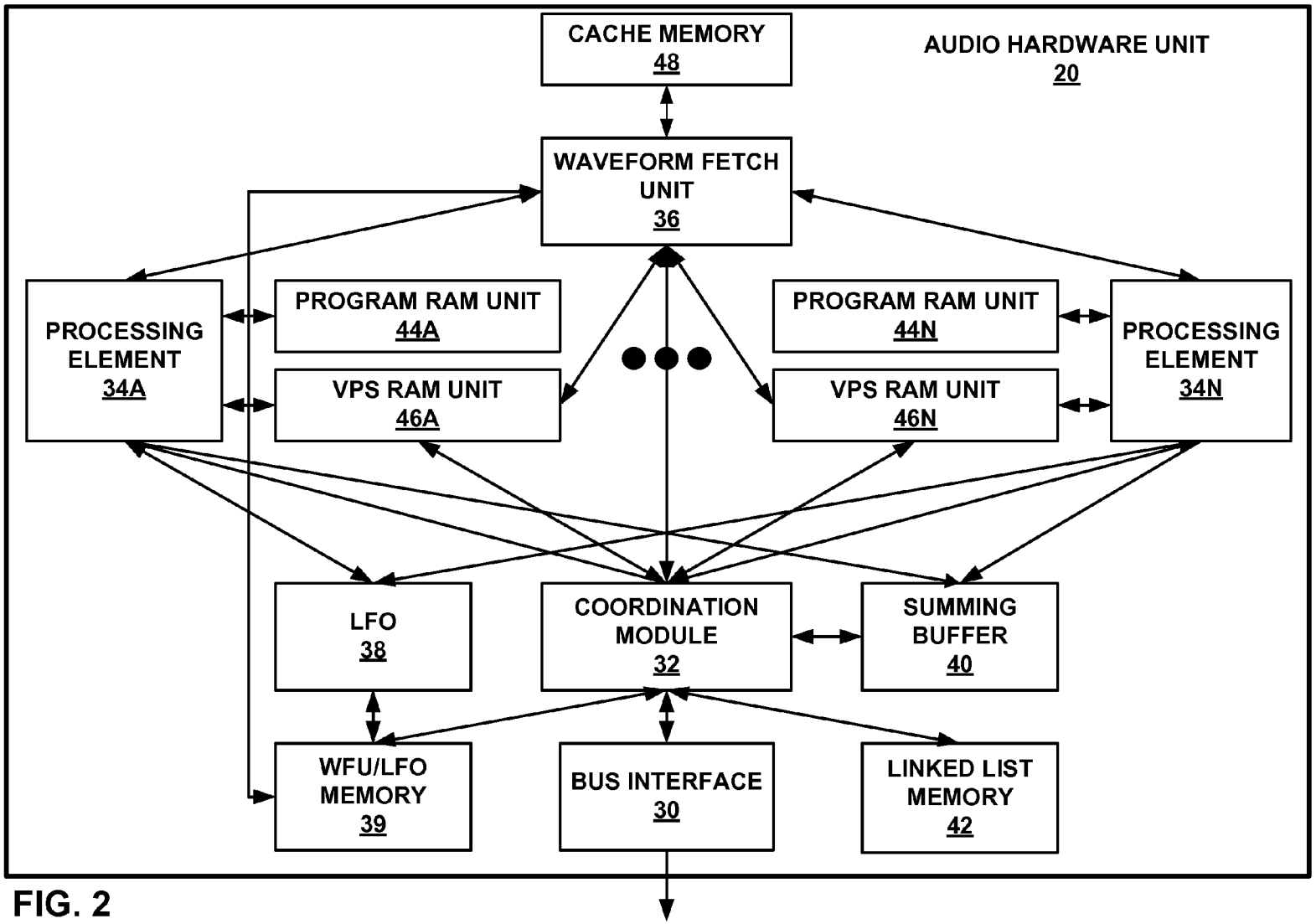
FIG. 2 is a block diagram of one example of a hardware unit for processing synthesis parameters in accordance with this disclosure.

FIG. 2 is a block diagram illustrating an exemplary audio hardware unit 20, which may correspond to audio hardware unit 14 of audio device 4. The implementation shown in FIG. 2 is merely exemplary as other hardware implementations could also be defined consistent with the teaching of this disclosure. As illustrated in the example of FIG. 2, audio hardware unit 20 includes a bus interface 30 to send and receive data. For example, bus interface 30 may include an AMBA High-performance Bus (AHB) master interface, an AHB slave interface, and a memory bus interface. AMBA stands for advanced microprocessor bus architecture. Alternatively, bus interface 30 may include an AXI bus interface, or another type of bus interface. AXI stands for advanced extensible interface.

In addition, audio hardware unit 20 may include a coordination module 32. Coordination module 32 coordinates data flows within audio hardware unit 20. When audio hardware unit 20 receives an instruction from DSP 12 (FIG. 1) to begin synthesizing an audio sample, coordination module 32 reads the synthesis parameters for the audio frame from memory 10, which were generated by DSP 12 (FIG. 1). These synthesis parameters can be used to reconstruct the audio frame. For the MIDI format, synthesis parameters describe various sonic characteristics of one or more MIDI voices within a given frame. For example, a set of MIDI synthesis parameters may specify a level of resonance, reverberation, volume, and/or other characteristics that can affect one or more voices.

At the direction of coordination module 32, synthesis parameters may be loaded from memory 10 (FIG. 1) into voice parameter set (VPS) RAM 46A or 46N associated with a respective processing element 34A or 34N. At the direction of DSP 12 (FIG. 1), program instructions are loaded from memory 10 into program RAM units 44A or 44N associated with a respective processing element 34A or 34N.

The instructions loaded into program RAM unit 44A or 44N instruct the associated processing element 34A or 34N to synthesize one of the voices indicated in the list of synthesis parameters in VPS RAM unit 46A or 46N. There may be any number of processing elements 34A-34N (collectively "processing elements 34"), and each may comprise one or more ALUs that are capable of performing mathematical operations, as well as one or more units for reading and writing data. Only two processing elements 34A and 34N are illustrated for simplicity, but many more may be included in hardware unit 20. Processing elements 34 may synthesize voices in parallel with one another. In particular, the plurality of different processing elements 34 work in parallel to process different synthesis parameters. In this manner, a plurality of processing elements 34 within audio hardware unit 20 can accelerate and possibly improve the generation of audio samples.

When coordination module 32 instructs one of processing elements 34 to synthesize a voice, the respective processing element may execute one or more instructions associated with the synthesis parameters. Again, these instructions may be loaded into program RAM unit 44A or 44N. The instructions loaded into program RAM unit 44A or 44N cause the respective one of processing elements 34 to perform voice synthesis. For example, processing elements 34 may send requests to a waveform fetch unit (WFU) 36 for a waveform specified in the synthesis parameters. Each of processing elements 34 may use WFU 36. An arbitration scheme may be used to resolve any conflicts if two or more processing elements 34 request use of WFU 36 at the same time.

In response to a request from one of processing elements 34, WFU 36 returns one or more waveform samples to the requesting processing element. However, because a wave can be phase shifted within a sample, e.g., by up to one cycle of the wave, WFU 36 may return two samples in order to compensate for the phase shifting using interpolation. Furthermore, because a stereo signal may include two separate waves for the two stereophonic channels, WFU 36 may return separate samples for different channels, e.g., resulting in up to four separate samples for stereo output.

After WFU 36 returns audio samples to one of processing elements 34, the respective processing element may execute additional program instructions based on the synthesis parameters. In particular, instructions cause one of processing elements 34 to request an asymmetric triangular wave from a low frequency oscillator (LFO) 38 in audio hardware unit 20. By multiplying a wave returned by WFU 36 with a triangular wave returned by LFO 38, the respective processing element may manipulate various sonic characteristics of the wave to achieve a desired audio affect. For example, multiplying a wave by a triangular wave may result in a wave that sounds more like a desired musical instrument.

Other instructions executed based on the synthesis parameters may cause a respective one of processing elements 34 to loop the waveform a specific number of times, adjust the amplitude of the waveform, add reverberation, add a vibrato effect, or cause other effects. In this way, processing elements 34 can calculate a waveform for a voice that lasts one MIDI frame. Eventually, a respective processing element may encounter an exit instruction. When one of processing elements 34 encounters an exit instruction, that processing element signals the end of voice synthesis to coordination module 32. The calculated voice waveform can be provided to summing buffer 40 at the direction of another store instruction during the execution of the program instructions. This causes summing buffer 40 to store that calculated voice waveform.

When summing buffer 40 receives a calculated wave from one of processing elements 34, summing buffer 40 adds the calculated wave to the proper instance of time associated with an overall wave for a MIDI frame. Thus, summing buffer 40 combines output of the plurality of processing elements 34. For example, summing buffer 40 may initially store a flat wave (i.e., a wave where all digital samples are zero.) When summing buffer 40 receives audio information such as a calculated wave from one of processing elements 34, summing buffer 40 can add each digital sample of the calculated wave to respective samples of the wave stored in summing buffer 40. In this way, summing buffer 40 accumulates and stores an overall digital representation of a wave for a full audio frame.

Summing buffer 40 essentially sums different audio information from different ones of processing elements 34. The different audio information is indicative of different instances of time associated with different generated voices. In this manner, summing buffer 40 creates audio samples representative of an overall audio compilation within a given audio frame.

Processing elements 34 may operate in parallel with one another, yet independently. That is to say, each of processing elements 34 may process a synthesis parameter and then move on to the next synthesis parameter once the audio information generated for the first synthesis parameter is added to summing buffer 40. Thus, each of processing elements 34 performs its processing tasks for one synthesis parameter independently of the other processing elements 34, and when the processing for synthesis parameter is complete that respective processing element becomes immediately available for subsequent processing of another synthesis parameter.

Eventually, coordination module 32 may determine that processing elements 34 have completed synthesizing all of the voices required for the current audio frame and have provided those voices to summing buffer 40. At this point, summing buffer 40 contains digital samples indicative of a completed wave for the current audio frame. When coordination module 32 makes this determination, coordination module 32 sends an interrupt to DSP 12 (FIG. 1). In response to the interrupt, DSP 12 may send a request to a control unit in summing buffer 40 (not shown) via direct memory exchange (DME) to receive the content of summing buffer 40. Alternatively, DSP 12 may also be pre-programmed to perform the DME. DSP 12 may then perform any post processing on the digital audio samples, before providing the digital audio samples to DAC 16 for conversion into the analog domain. In some cases, the processing performed by audio hardware unit 20 with respect to a frame N+2 occurs simultaneously with synthesis parameter generation by DSP 12 (FIG. 1) respect to a frame N+1, and scheduling operations by processor 8 (FIG. 1) respect to a frame N.

Cache memory 48, WFU/LFO memory 39 and linked list memory 42 are also shown in FIG. 2. Cache memory 48 may be used by WFU 36 to fetch base waveforms in a quick and efficient manner. WFU/LFO memory 39 may be used by coordination module 32 to store voice parameters of the voice parameter set. In this way, WFU/LFO memory 39 can be viewed as memories dedicated to the operation of waveform fetch unit 36 and LFO 38. Linked list memory 42 may comprise a memory used to store a list of voice indicators generated by DSP 12. The voice indicators may comprise pointers to one or more synthesis parameters stored in memory 10. Each voice indicator in the list may specify the memory location that stores a voice parameter set for a respective MIDI voice. The various memories and arrangements of memories shown in FIG. 2 are purely exemplary. The techniques described herein could be implemented with a variety of other memory arrangements.

Any number of processing elements 34 may be included in audio hardware unit 20 provided that a plurality of processing elements 34 operate simultaneously with respect to different synthesis parameters stored in memory 10 (FIG. 1) or memory 42 (FIG. 2). A first audio processing element 34A, for example, processes a first audio synthesis parameter to generate first audio information while another audio processing element 34N processes a second audio synthesis parameter to generate second audio information. Summing buffer 40 can then combine the first and second audio information in the creation of one or more audio samples. Similarly, a third audio processing element (not shown) and a fourth processing element (not shown) may process third and forth synthesis parameters to generate third and fourth audio information, which can also be accumulated in summing buffer 40 in the creation of the audio samples.

Processing elements 34 may process all of the synthesis parameters for an audio frame. After processing each respective synthesis parameter, the respective one of processing elements 34 adds its processed audio information in to the accumulation in summing buffer 40, and then moves on to the next synthesis parameter. In this way, processing elements 34 work collectively to process all of the synthesis parameters generated for one or more audio files of an audio frame. Then, after the audio frame is processed and the samples in summing buffer are sent to DSP 12 for post processing, processing elements 34 can begin processing the synthesis parameters for the audio files of the next audio frame.

Figure 3:
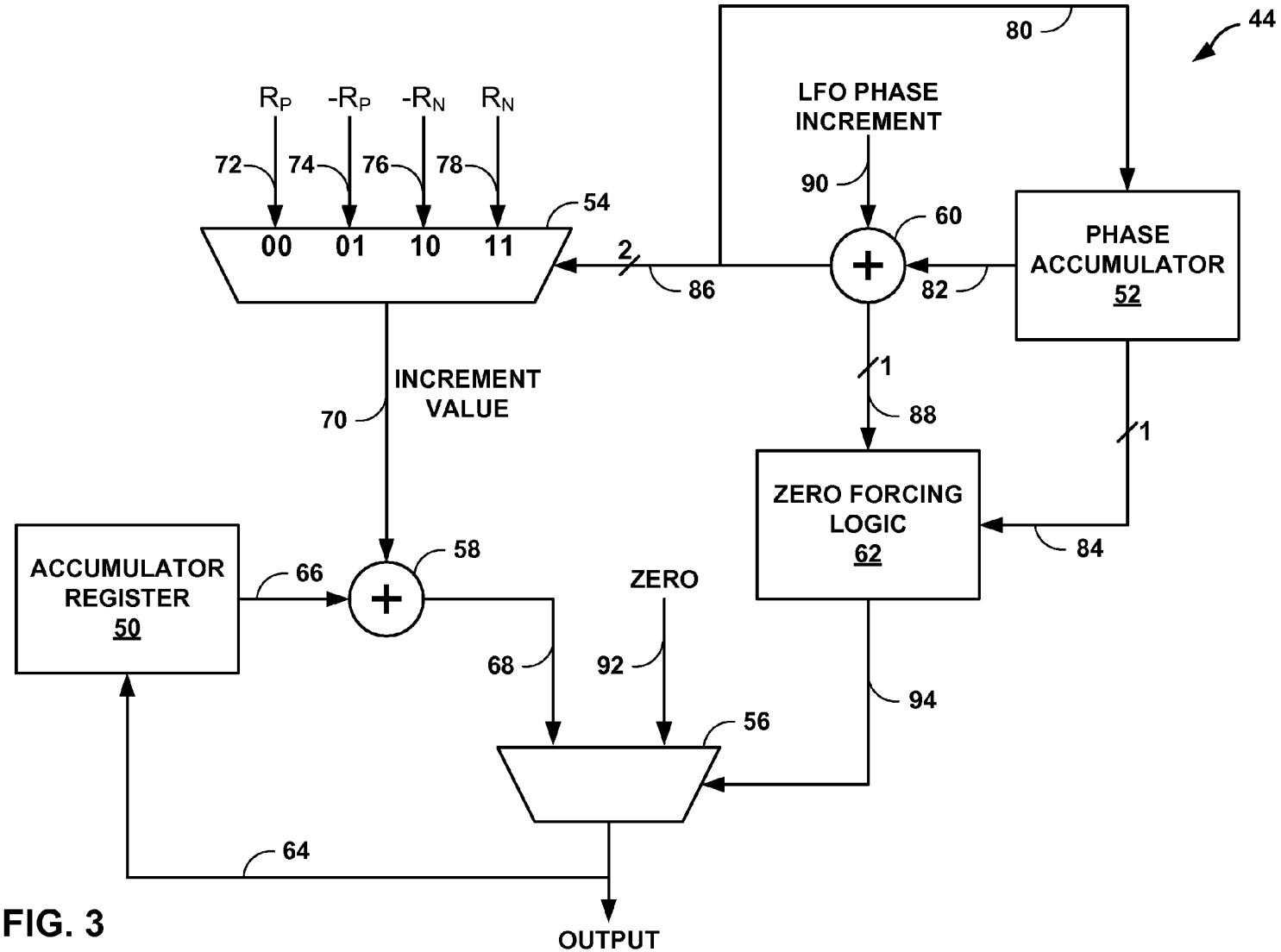
FIG. 3 is a schematic diagram illustrating an exemplary triangular wave generator for generating a set of data points that form a triangular wave having a desired gain and frequency in accordance with this disclosure.

FIG. 3 is a schematic diagram illustrating an exemplary triangular wave generator 44, which may correspond to low frequency oscillator 38 of audio hardware unit 20. The triangular wave generator 44 can generate a set of data points that form a triangular wave having a desired frequency and gain. The device includes an accumulator register 50, a phase accumulator 52, multiplexers 54, 56, adders 58, 60, zero forcing logic 62, and lines 64, 66, 68, 70, 72, 74, 78, 80, 82, 84, 86, 88, 90, 92, 94.

Accumulator register 50 can store a single data point from the set of data points that form a triangular wave. Accumulator register 50 is electrically coupled to adder 58 and the output of multiplexer 56. Accumulator register 50 outputs the current data point via line 66. During a single clock-cycle, accumulator register 50 receives, via line 64, either the next data point or a zero value depending on the output of multiplexer 56. During the next clock-cycle, accumulator register 50 outputs the value received from the previous clock cycle via line 66 as the current data point. For a given clock cycle, the current data point is defined as the output of the accumulator register via line 66 and the next data point is defined as the output of adder 58 via line 68.

Phase accumulator 52 can store a single phase data point corresponding to the time-axis of a triangular wave. In general, the phase data determines which of the four ratios 72, 74, 76, 78 is selected to be the increment value 70. Phase accumulator 52 is electrically coupled to adder 60 via lines 80 and 82 and to zero forcing logic 62 via line 84. During a particular clock-cycle, phase accumulator 52 receives, via line 80, the next phase data point and outputs the current phase data point via line 82. During the next clock-cycle, phase accumulator 52 outputs the value received from the previous clock cycle via line 80 as the current phase data point. For a given clock cycle, the current phase data point is defined as the output of phase accumulator 52 via line 82 and the next phase data point is defined as the output of adder 60 via line 80. Accumulator register 50 and phase accumulator 52 can be implemented utilizing any sequential storage element such as a flip-flop, latch, RAM cell, or the like.

Multiplexer 54 outputs an increment value on line 70 based on a selection of one of four ratios provided on input lines 72, 74, 76, 78. The selection is based on control line 86, which contains the two most significant bits of the next phase data point. When the two most significant bits are "00", multiplexer 54 selects the ratio $R_P$ as the increment value. Similarly, when the two most significant bits are "01", multiplexer 54 selects the ratio $-R_P$ as the increment value. When the most significant bits are "10", multiplexer 54 selects the ratio $-R_N$ as the increment value. Finally, when the most significant bits are "11", multiplexer 54 selects the ratio $R_N$ as the increment value. The increment value is placed on the output of multiplexer 54, which is transmitted to adder 58 via line 70. Multiplexer 54 can be implemented using any digital selection scheme such as logic gates, an FPGA, RAM, or the like. Although multiplexer 54 shown here has four ratio values and the selection is based on the two most significant bits of the next phase data point, it should be recognized that other examples of the techniques described herein may utilize a multiplexer 54 having more or less inputs and additional or fewer selection bits. In addition, other examples of the techniques described herein may utilize a multiplexer that selects an increment value based on the current phase data point, which is the output of phase accumulator 52 via line 82.

Adder 58 can generate the sum of the current data point and the increment value. Adder 58 receives the current data point from accumulator register 50 via line 66 and receives the increment value from multiplexer 54 via line 70. The sum is defined as the next data point and is placed as an output on line 68.

Adder 60 can generate the sum of the current phase data point and the phase increment. Adder 60 receives the current phase data point from phase accumulator 52 via line 82 and receives the phase increment via line 90. The sum is defined as the next phase data point and is placed as an output on line 80. Both adders 58, 60 can be implemented using any conventional digital adding circuitry as is known in the art.

In accordance with an example of this disclosure, the ratios $R_P$ and $R_N$ and the phase increment can be calculated according to the following formulas:

$$R_P=\text{round}(4*G_P*F_t) \quad (1)$$

$$R_N=\text{round}(4*G_N*F_t) \quad (2)$$

$$\text{Phase Increment}=\text{round}(2^{\wedge}B*F_t) \quad (3)$$

where:

$G_P$=the positive gain $G_N$=the negative gain

B=the number of bits in the phase accumulator $F_t$=the normalized desired frequency The positive gain is the value of the positive peak or the highest point of the triangular wave. The negative gain is the value of the negative peak or the lowest point of the triangular wave. The phase increment is calculated so that the values in phase accumulator 52 will traverse the entire range of phase accumulator 52 in one period of the desired triangular wave. The value B represents the number of bits in the phase accumulator. The normalized desired frequency is the desired frequency divided by the clocking rate of the hardware.

In the exemplary audio hardware unit 20 shown in FIG. 2, the positive gain, the negative gain, and the normalized desired frequency can be supplied to low frequency oscillator 38 by the different processing elements 34A-34N when a particular articulation, such as a vibrato or a tremolo, is required by a particular processing element.

One advantage of the techniques described herein is that the positive and negative ratios contain information regarding both the desired gain and frequency of the resulting triangular wave. These ratios allow triangular wave generator 44 to calculate successive data points by adding successive increment values without the need of utilizing a multiplier during each clock cycle to correct for the gain. Because hardware multipliers can take up valuable chip area and commonly require large amounts of processing time, the elimination of the need for a multiplier can reduce the complexity of the hardware and allow for more efficient operation of a triangular wave generator.

Zero forcing logic block 62 detects a phase accumulator roll over condition and resets accumulator register 50 to a zero value to start a new period of the triangular wave. A roll over condition is detected when the most significant bit of the next phase data point is a logic zero and the most significant bit of the current phase data point is a logic one. A roll over condition in phase accumulator 52 can happen simultaneously with a negative to positive transition in accumulator register 50. Thus, it should be noted that in other examples, zero forcing logic block 62 can be implemented by detecting when the current data point is negative and the next data point is positive.

Multiplexer 56 can force the next data point received by the accumulator register 50 to be a zero value based on the output of zero forcing logic block 62. Multiplexer 56 may select between the next data point from line 68 and the zero value on line 92. The selection may be based on the output of zero forcing logic block 62, which is transmitted to the multiplexer via line 94. During normal operation with no roll over conditions, control line 94 remains inactive and multiplexer 56 places the next data point on line 64 as an output of triangular wave generator 44 and as an input to accumulator register 50. When a roll over condition occurs, zero forcing logic block 62 activates control line 94 and multiplexer 56 places a zero value on line 64. It should be noted that in other embodiments of the present invention, the output of triangular wave generator 44 may also be connected to the output of accumulator register 50 via line 68.

Another advantage of the techniques described herein is that zero-forcing logic block 62 prevents positive and negative biases from occurring in subsequent periods of the triangular wave due to the finite precision of phase accumulator 52 and the phase increment. For example, consider a case where the number of data points in a single period of the triangular waveform is not an even multiple of four. When a roll over condition occurs, the value in accumulator register 50 may not be zero. If no correction takes place, the non-zero offset can continue to accumulate over successive clock cycles with the potential to create positive or negative biases in successive triangular waves. The introduction of a positive or negative bias may also have the potential to cause a deviation in the frequency of the triangular wave over several periods. By utilizing zero-forcing logic block 62, the bias and frequency problems associated with a roll over offset value can be removed because zero-forcing logic block 62 forces the next data point to be a zero whenever a roll over condition occurs.

Figure 4:
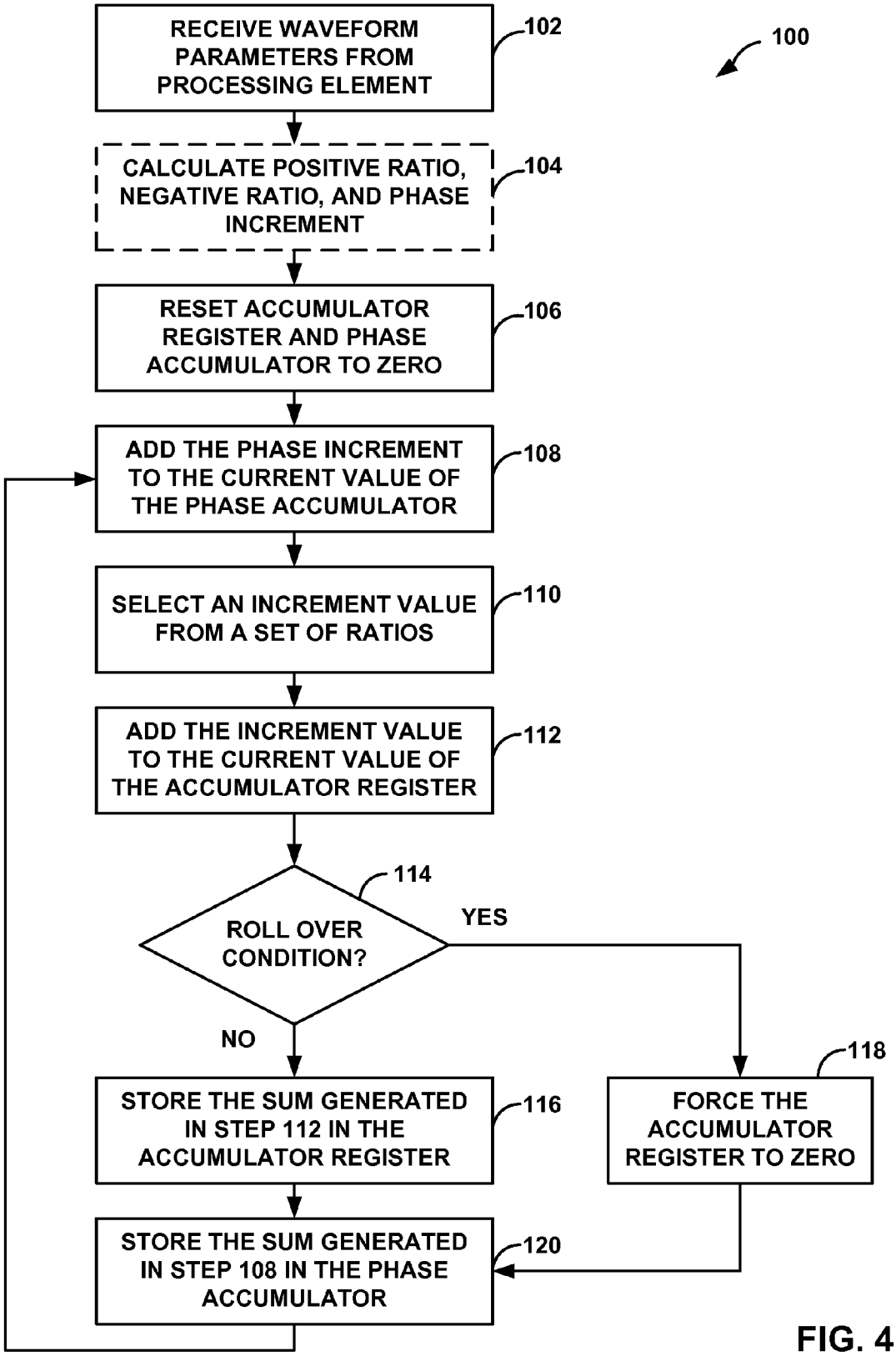
FIG. 4 is a flowchart illustrating an exemplary method for generating a set of data points that form a triangular wave having a desired frequency and a desired gain in accordance with this disclosure.

FIG. 4 is a flowchart illustrating an exemplary method 100 for generating a set of data points that form a triangular wave having a desired frequency and a desired gain in accordance with an example of this disclosure. The method illustrated in FIG. 4 may utilize the exemplary triangular wave generator 44 in FIG. 3.

In step 102, waveform parameters are received by triangular wave generator 44. The waveform parameters may be transmitted to triangular wave generator 44 by a processing element 34 in the audio hardware unit 20. The waveform parameters may contain information concerning the desired positive gain, the desired negative gain, and the desired frequency of the triangular wave to be generated. In other embodiments, the waveform parameters that are received by triangle wave generator 44 may contain information concerning the positive ratio, the negative ratio, and the phase increment of the desired triangular wave.

In step 104, triangular wave generator 44 calculates the positive ratio, the negative ratio, and the phase increment according to the equations (1)-(3). This step is optional and is illustrated by broken lines because the positive ratio, the negative ratio, and the phase increment may already be provided by the processing element in step 102.

In step 106, triangular wave generator 44 resets accumulator register 50 and phase accumulator 52 to zero to begin generation of a triangular waveform. In step 108, triangular wave generator 44 adds the phase increment to the current value of phase accumulator 52 to generate a next phase data point. The current value of phase accumulator 52 corresponds to the current phase data point.

In step 110, triangular wave generator 44 selects an increment value from a set of ratios. The set of ratios may include the positive ratio, the negative ratio, and the additive inverses of both the positive and negative ratios. The selection of the increment value may be based on the two most significant bits of the sum generated in step 108. In other examples, the selection of the increment value may be based on the two most significant bits of the current phase data point.

In step 112, triangular wave generator 44 adds the increment value selected in step 110 to the current value of the accumulator register 50. The current value of accumulator register 50 corresponds to the current data point.

In step 114, triangular wave generator 44 detects whether a roll over condition has occurred in phase accumulator 52. The roll over condition can be detected by examining the most significant bit of the current value of phase accumulator 52 and the most significant bit of the sum generated in step 108. If the most significant bit of the current value of phase accumulator 52 is a logic one and the most significant bit of the sum generated in step 108 is a logic zero, a roll over condition has occurred and the triangular wave generator proceeds to step 118. If any other combination occurs, a roll over condition has not occurred and the triangular wave generator proceeds to step 116.

In other examples, the roll over condition can be detected by examining the output of the current value of accumulator register 50 and the sum generated in step 112. If the current value of accumulator register 50 is negative and the sum generated in step 112 is positive, a roll over condition has occurred and triangular wave generator 44 proceeds to step 118. If any other combination occurs, a roll over condition has not occurred and triangular wave generator proceeds to step 116.

In step 116, triangular wave generator 44 stores the sum generated in step 112 in accumulator register 50. This step causes the next data point of the current clock cycle to become the current data point in the next clock cycle. In step 118, triangular wave generator 44 forces accumulator register 50 to zero. This step causes the current data point to be zero in the next clock cycle.

In step 120, triangular wave generator 44 stores the sum generated in step 108 in phase accumulator 52. This step causes the next phase data point in the current clock cycle to become the current phase data point in the next clock cycle.

After step 120, the triangular wave generator 44 loops back to step 108. Triangular wave generator 44 can loop as many times as necessary to iteravely generate a set of data points that form a triangular wave.

Figure 5:
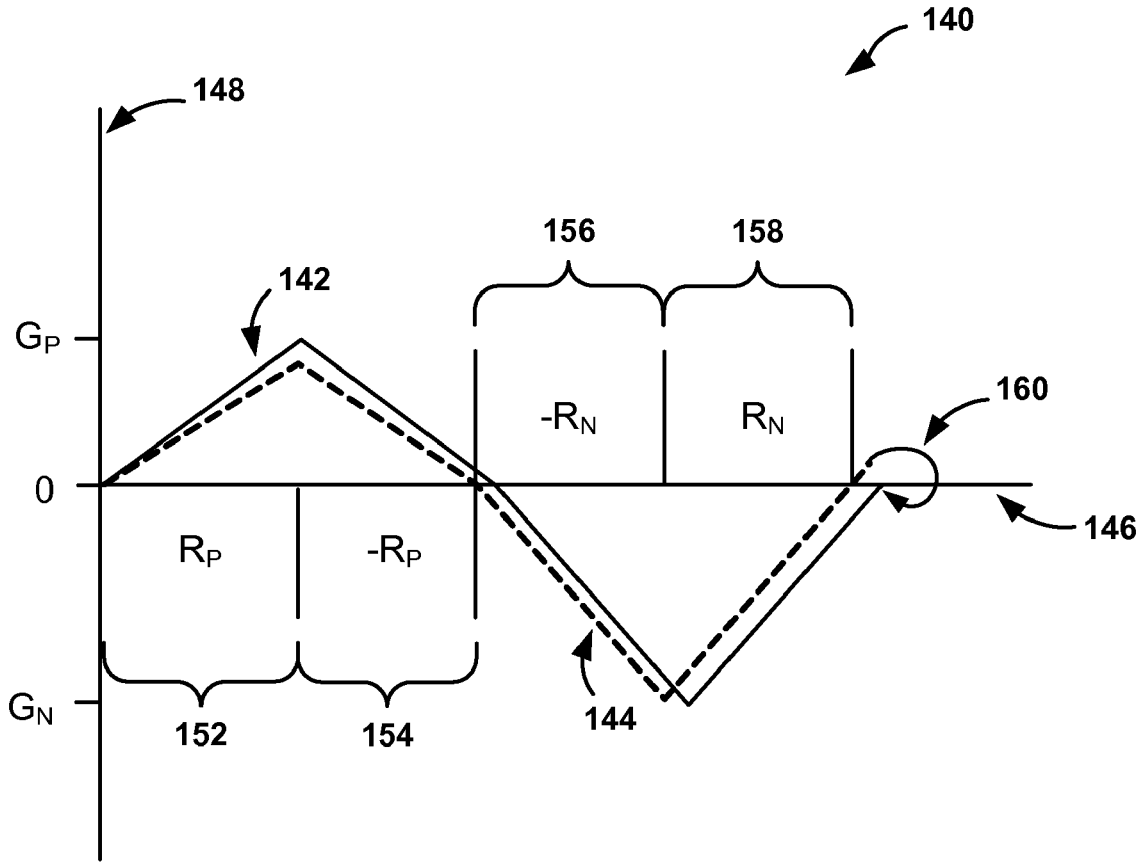
FIG. 5 is a graph diagram illustrating one period of an exemplary triangular wave generated by the triangular wave generator and method shown in FIGS. 3 and 4 respectively.

FIG. 5 is a diagram 140 illustrating one period of an exemplary triangular wave generated by a triangle wave generator such as by triangular wave generator 44 shown in FIG. 3 using method 100 shown in FIG. 4. The solid line 142 represents a desired triangular wave having a desired positive gain, a desired negative gain, and a desired frequency. The dashed line 144 represents a triangular wave generated by triangular wave generator 44 using method 100. The current phase data point, which is stored in phase accumulator 52, corresponds to a particular time value located on a time axis 146. As the value in phase accumulator 52 increases, the current phase data points traverse time axis 146 from left to right. Based on the two most significant bits of phase accumulator 52, four regions 152, 154, 156, 158 are defined along the time axis.

The current data point, which is stored in accumulator register 50, corresponds to the output value associated with axis 148. As time axis 146 is traversed, different ratios are selected as the increment value based on the region of operation 152, 154, 156, 158 of triangular wave generator 44. For example, in region 152 the two most significant bits of the next phase data point are "00" and the ratio added to the accumulator register 50 is $R_P$. This causes the output data points of the triangular wave generator 44 to increase to a value at or near the desired positive gain. Similarly, in region 154, the two most significant bits of the next phase data point are "01" and the additive inverse of the ratio $R_P$ is added to the accumulator register 50. This causes the output data points to decrease to a value at or near zero. In region 156, the two most significant bits of the next phase data point are "10" and the additive inverse of the ratio $R_N$ is added to the accumulator register 50. This causes the output data points to decrease to a value at or near the additive inverse of $R_N$. Finally, in region 158, the two most significant bits of the next phase data point are "11" and the ratio $R_N$ is added to accumulator register 50. This causes the output data points to increase to a value at or near zero. After the wave has traversed region 158, a roll over condition is detected and the accumulator register 50 is forced to zero 160 to start a new period of the triangular wave.

Various examples have been described in this disclosure. For example, a triangular wave generator that does not require the use of a multiplier has been disclosed. The elimination of the need for a multiplier can reduce the complexity of the hardware and allow for more efficient operation of a triangular wave generator. In addition, a triangular wave generator that corrects for any offset during a roll over condition has also been described. Correcting any offset that occurs during a roll over condition can alleviate many of bias problems associated with a roll over offset and also allow for better control over the frequency of the resulting triangular waves. Nevertheless, various modifications can be made to the techniques described above. For example, other types of devices could also implement the triangular wave generation techniques described herein. Also, other approaches could be utilized for detecting and correcting roll over offset values such as examining the output of the accumulator register or forcing the accumulator to zero on the negative slope of the triangular wave rather than the positive slope.

The techniques described herein may be implemented in hardware, software, firmware, or any combination thereof. Any features described as modules or components may be implemented together in an integrated logic device or separately as discrete but interoperable logic devices. If implemented in software, the techniques may be realized at least in part by a computer-readable medium comprising instructions that, when executed, performs one or more of the methods described above. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The code may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, this disclosure may be directed to a circuit, such as an integrated circuit, chipset, ASIC, FPGA, logic, or various combinations thereof configured or adapted to perform one or more of the techniques described herein.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

These and other embodiments are within the scope of the following claims.

The invention claimed is:

1. A method for generating a set of data points that form a triangular wave having a desired frequency and a desired gain, the method comprising:

determining a phase increment based upon the desired frequency of the triangular wave;

adding the phase increment to a current phase data point to generate a next phase data point;

determining an increment value based upon the next phase data point, the desired frequency, and the desired gain of the triangular wave;

adding the increment value to a current data point to generate a next data point, the current data point and the next data point forming a subset of the set of data points.

2. The method of claim 1, additionally comprising:

adding the increment value to the next data point to generate a third data point, the current data point, the next data point, and the third data point forming a new subset of the set of data points.

3. The method of claim 1, wherein the increment value is selected from a set of ratios, the ratios corresponding to a desired positive gain, a desired negative gain, and the desired frequency of the triangular wave.

4. The method of claim 3 wherein the desired positive gain and the desired negative gain are equal to each other.

5. The method of claim 3 wherein the set of ratios contains four ratios and the selection of the increment value is based on the two most significant bits of the next phase data point.

6. The method of claim 1 wherein the determining the phase increment is based on the number of bits in a phase accumulator and the desired frequency of the triangular wave.

7. The method of claim 1, further comprising:

forcing the next data point to zero when the current data point is negative and the sum of the current data point and the increment value is positive.

8. The method of claim 1, further comprising:

forcing the next data point to zero when the most significant bit of the current phase data point is one and the most significant bit of the next phase data point is zero.

9. The method of claim 1, wherein the triangular wave is the output of a low frequency oscillator.

10. The method of claim 9, wherein the low frequency oscillator is utilized in a Musical Instrument Digital Interface (MIDI) hardware implementation.

11. A device for generating a set of data points that form a triangular wave having a desired frequency and a desired gain, the device comprising:

a phase calculation unit that determines a phase increment based upon the desired frequency of the triangular wave;

a first adder that adds the phase increment to a current phase data point to generate a next phase data point;

an electrical circuit that determines an increment value based upon the next phase data point, the desired frequency, and the desired gain of the triangular wave; and a second adder that adds the increment value to a current data point to generate a next data point, the current data point and the next data point forming a subset of the set of data points.

12. The device of claim 11 wherein the second adder additionally adds the increment value to the next data point to generate a third data point, the current data point, the next data point, and the third data point forming a new subset of the set of data points.

13. The device of claim 11, wherein the electrical circuit comprises a selection unit that selects the increment value from a set of ratios, the ratios corresponding to a desired positive gain, a desired negative gain, and the desired frequency of the triangular wave.

14. The device of claim 13 wherein the desired positive gain and the desired negative gain are equal to each other.

15. The device of claim 13 wherein the set of ratios contains four ratios and the selection unit selects the increment value based upon the two most significant bits of the next phase data point.

16. The device of claim 1 wherein the phase calculation unit determines the phase increment based on the number of bits in a phase accumulator and the desired frequency of the triangular wave.

17. The device of claim 11, further comprising:

a zero-forcing logic block that forces the next data point to zero when the current data point is negative and the sum of the current data point and the increment value is positive.

18. The device of claim 11, further comprising:

a zero-forcing logic block that forces the next data point to zero when the most significant bit of the current phase data point is one and the most significant bit of the next phase data point is zero.

19. The device of claim 11, further comprising a low frequency oscillator that outputs the set of data points forming the triangular wave to a processor.

20. The device of claim 19, wherein the low frequency oscillator is utilized in a Musical Instrument Digital Interface (MIDI) hardware implementation.

21. A device for generating a set of data points that form a triangular wave having a desired frequency and a desired gain, the device comprising:

means for determining a phase increment based upon the desired frequency of the triangular wave;

means for adding the phase increment to a current phase data point to generate a next phase data point;

means for determining an increment value based upon the next phase data point, the desired frequency, and the desired gain of the triangular wave; and means for adding the increment value to a current data point to generate a next data point, the current data point and the next data point forming a subset of the set of data points.

22. The device of claim 21, further comprising:

means for adding the increment value to the next data point to generate a third data point, the current data point, the next data point, and the third data point forming a new subset of the set of data points.

23. The device of claim 21, further comprising:

means for selecting the increment value from a set of ratios, the ratios corresponding to a desired positive gain, a desired negative gain, and the desired frequency of the triangular wave.

24. The device of claim 23 wherein the desired positive gain and the desired negative gain are equal to each other.

25. The device of claim 23 wherein the set of ratios contains four ratios and the selection of the increment value is based upon the two most significant bits of the next phase data point.

26. The device of claim 21 wherein the phase increment is determined based on the number of bits in a phase accumulator and the desired frequency of the triangular wave.

27. The device of claim 21, further comprising:

means for forcing the next data point to zero when the current data point is negative and the sum of the current data point and the increment value is positive.

28. The device of claim 21, further comprising:

means for forcing the next data point to zero when the most significant bit of the current phase data point is one and the most significant bit of the next phase data point is zero.

29. The device of claim 21, wherein the triangular wave is the output of a low frequency oscillator.

30. The device of claim 29, wherein the low frequency oscillator is utilized in a Musical Instrument Digital Interface (MIDI) hardware implementation.

31. A computer-readable medium comprising instructions that upon execution by one or more processors cause the processors to generate a set of data points that form a triangular wave having a desired frequency and a desired gain, wherein the instructions cause the one or more processors to:

determine a phase increment based on the desired frequency of the triangular wave;

add the phase increment to a current phase data point to generate a next phase data point;

determine an increment value based upon the next phase data point, the desired frequency, and the desired gain of the triangular wave;

add the increment value to a current data point to generate a next data point, the current data point and the next data point forming a subset of the set of data points.

32. The computer-readable medium of claim 31, additionally comprising instructions that cause the one or more processors to:

add the increment value to the next data point to generate a third data point, the current data point, the next data point, and the third data point forming a new subset of the set of data points.

33. The computer-readable medium of claim 31, wherein the increment value is selected from a set of ratios, the ratios corresponding to a desired positive gain, a desired negative gain, and the desired frequency of the triangular wave.

34. The computer-readable medium of claim 33, wherein the desired positive gain and the desired negative gain are equal to each other.

35. The computer-readable medium of claim 33, wherein the set of ratios contains four ratios and the selection of the increment value is based on the two most significant bits of the next phase data point.

36. The computer-readable medium of claim 31, wherein the phase increment is determined based on the number of bits in a phase accumulator and the desired frequency of the triangular wave.

37. The computer-readable medium of claim 31, wherein the instructions cause the one or more processors to:

force the next data point to zero when the current data point is negative and the sum of the current data point and the increment value is positive.

38. The computer-readable medium of claim 31, wherein the instructions cause the one or more processors to:

force the next data point to zero when the most significant bit of the current phase data point is one and the most significant bit of the next phase data point is zero.

39. The computer-readable medium of claim 31, wherein the triangular wave is the output of a low frequency oscillator.

40. The computer-readable medium of claim 39, wherein the low frequency oscillator is utilized in a Musical Instrument Digital Interface (MIDI) implementation.

41. A circuit for generating a set of data points that form a triangular wave having a desired frequency and a desired gain, wherein the circuit is adapted to:

determine a phase increment based on the desired frequency of the triangular wave;

add the phase increment to a current phase data point to generate a next phase data point;

determine an increment value based upon the next phase data point, the desired frequency, and the desired gain of the triangular wave;

add the increment value to a current data point to generate a next data point, the current data point and the next data point forming a subset of the set of data points.

42. The circuit of claim 41, wherein the circuit is additionally adapted to:

add the increment value to the next data point to generate a third data point, the current data point, the next data point, and the third data point forming a new subset of the set of data points.

43. The circuit of claim 41, wherein the increment value is selected from a set of ratios, the ratios corresponding to a desired positive gain, a desired negative gain, and the desired frequency of the triangular wave.

44. The circuit of claim 43, wherein the desired positive gain and the desired negative gain are equal to each other.

45. The circuit of claim 43, wherein the set of ratios contains four ratios and the selection of the increment value is based on the two most significant bits of the next phase data point.

46. The circuit of claim 41, wherein the selection of the phase increment is based on the number of bits in a phase accumulator and the desired frequency of the triangular wave.

47. The circuit of claim 41, wherein the circuit is adapted to:

force the next data point to zero when the current data point is negative and the sum of the current data point and the increment value is positive.

48. The circuit of claim 41, wherein the circuit is adapted to:

force the next data point to zero when the most significant bit of the current phase data point is one and the most significant bit of the next phase data point is zero.

49. The circuit of claim 41, wherein the triangular wave is the output of a low frequency oscillator.

50. The circuit of claim 49, wherein the low frequency oscillator is utilized in a Musical Instrument Digital Interface (MIDI) implementation.

* * * * *

UNITED STATES PATENT AND TRADEMARK OFFICE

CERTIFICATE OF CORRECTION

PATENT NO. : 7,687,703 B2
APPLICATION NO. : 12/042190
DATED : March 30, 2010
INVENTOR(S) : Molloy et al.

It is certified that error appears in the above-identified patent and that said Letters Patent is hereby corrected as shown below:

Column 16, line 14, claim 9: “the output” to read as --an output--

Column 16, line 50, claim 16: “claim 1” to read as --claim 11--

Column 17, line 48, claim 29: “the output” to read as --an output--

Column 18, line 37, claim 39: “the output” to read as --an output--

Column 20, line 7, claim 49: “the output” to read as --an output--

Signed and Sealed this
Fifth Day of July, 2011

David J. Kappos

David J. Kappos
*Director of the United States Patent and Trademark Office*